US007617018B2

(12) United States Patent
Ford et al.

(10) Patent No.: US 7,617,018 B2
(45) Date of Patent: Nov. 10, 2009

(54) PLATFORM ATTITUDE ADJUSTMENT AUGMENTATION METHOD AND APPARATUS

(75) Inventors: Robert M. Ford, Troy, MI (US); John P. Manfreda, Sterling Heights, MI (US); Mark J. Woloszyk, Sterling Heights, MI (US); Shawn P. Haley, Troy, MI (US)

(73) Assignee: Innovative Design Solutions, Troy, MI (US)

( * ) Notice: Subject to any disclaimer, the term of this patent is extended or adjusted under 35 U.S.C. 154(b) by 624 days.

(21) Appl. No.: 11/253,144

(22) Filed: Oct. 18, 2005

(65) Prior Publication Data

US 2006/0088385 A1 Apr. 27, 2006

Related U.S. Application Data

(60) Provisional application No. 60/619,768, filed on Oct. 18, 2004.

(51) Int. Cl.
*G01M 1/00* (2006.01)

(52) U.S. Cl. ..... 700/279; 701/36; 701/38; 280/6.15; 280/6.153; 280/6.154; 280/6.155; 280/6.156; 280/6.157; 180/41; 187/204; 73/65.01; 52/126.5; 248/188.3

(58) Field of Classification Search ..... 701/36, 701/38; 280/6.15, 6.154, 6.155, 6.156, 6.153, 280/6.157, 5.06, 5.07; 180/41; 700/279; 108/1, 6; 187/204; 52/126.5; 73/65.01
See application file for complete search history.

(56) References Cited

U.S. PATENT DOCUMENTS 3,606,247 A 9/1971 Liston
3,853,075 A * 12/1974 Burch ..... 108/136
3,943,637 A 3/1976 Hanser
3,994,797 A * 11/1976 Smith et al. ..... 1/1
4,061,309 A 12/1977 Hanser
4,084,830 A 4/1978 Daniel, Jr. et al.
4,148,125 A 4/1979 Hanser
4,165,861 A 8/1979 Hanser
4,380,258 A 4/1983 Hanser
4,597,584 A 7/1986 Hanser
4,655,269 A 4/1987 Hanser et al.
4,743,037 A 5/1988 Hanser (Continued)

FOREIGN PATENT DOCUMENTS

EP 10019 A1 * 4/1980

(Continued)

OTHER PUBLICATIONS

Translated abstract of EP 10019 A1.*

*Primary Examiner*—Khoi Tran
*Assistant Examiner*—Nikhil Sriraman
(74) *Attorney, Agent, or Firm*—Reising Ethington P.C.

(57) ABSTRACT

A method and apparatus for increasing platform attitude adjustment range for platforms supported by jacks in which the apparatus includes jacks for supporting a platform at spaced-apart locations, jack drive mechanisms, and a controller connected to each of the jacks through their respective jack drive mechanisms and programmed to adjust platform attitude by coordinating jack movement. The controller coordinates jack movement by selecting and commanding at least one of the jacks to retract and selecting and commanding at least one other of the jacks to extend.

22 Claims, 5 Drawing Sheets

U.S. PATENT DOCUMENTS 4,746,133 A 5/1988 Hanser et al.
5,143,386 A * 9/1992 Uriarte ..... 254/418
5,176,391 A 1/1993 Schneider et al.
5,188,379 A 2/1993 Krause et al.
5,511,459 A 4/1996 Hanser et al.
5,547,040 A 8/1996 Hanser et al.
5,628,521 A 5/1997 Schneider et al.
5,676,385 A 10/1997 Schneider et al.
5,684,698 A * 11/1997 Fujii et al. ..... 701/38
5,772,270 A 6/1998 Hanser et al.
5,822,870 A * 10/1998 King-Yang ..... 33/1 M
5,890,721 A 4/1999 Schneider et al.
5,901,969 A 5/1999 Schneider et al.
5,908,215 A 6/1999 Hanser et al.
5,913,525 A 6/1999 Schneider et al.
6,050,573 A 4/2000 Kunz
6,161,845 A * 12/2000 Shono et al. ..... 280/6.15
6,286,441 B1 * 9/2001 Burdi et al. ..... 108/147
6,584,385 B1 * 6/2003 Ford et al. ..... 701/36
6,848,693 B2 * 2/2005 Schneider ..... 280/6.153
7,066,474 B2 * 6/2006 Hiebert et al. ..... 280/6.153
7,104,547 B2 * 9/2006 Brookes et al. ..... 280/6.153
7,226,057 B2 * 6/2007 Eichhorn et al. ..... 280/6.153
2004/0094913 A1 * 5/2004 Flynn et al. ..... 280/6.153
2006/0226612 A1 * 10/2006 Smith et al. ..... 280/6.153

FOREIGN PATENT DOCUMENTS

WO WO 00/30882 * 2/2000

* cited by examiner

PLATFORM ATTITUDE ADJUSTMENT AUGMENTATION METHOD AND APPARATUS

CROSS-REFERENCES TO RELATED APPLICATIONS

This application claims priority from provisional Application No. 60/619,768, filed Oct. 18, 2004, which is incorporated by reference.

STATEMENT REGARDING FEDERALLY SPONSORED RESEARCH OR DEVELOPMENT

Not Applicable

BACKGROUND OF THE INVENTION

1. Field of the Invention

This invention relates generally to a method and apparatus for increasing platform attitude adjustment range for platforms supported by jacks of a given stroke length.

2. Description of the Related Art Including Information Disclosed Under 37 CFR 1.97 and 1.98

There are a wide variety of commercial and industrial applications requiring mobile platforms that can be aligned relative to Earth's gravity (true level) by a known angle, or set of angles. The platforms are mobile and are often self-propelled, allowing them to be easily moved to various locations on the Earth's surface. However, once at a given location the platform must be supported and aligned relative to Earth's gravity before operating in its intended capacity. Examples of such platforms include: heavy industrial equipment, cranes, cherry pickers, and recreational vehicles.

The support and alignment of the platform is often accomplished through the use of jacks attached at different positions around the platform. The jacks may be extended to contact the ground, creating a rigid support base for the platform. By extending and retracting specific jacks, the platform may be aligned to at any angle allowed within the mechanical limits of the platform and jacks. The jacks may be hydraulically driven, or may be driven by DC electric motors.

With the advent of these platforms came the need for systems that can control jack movement (extension and retraction) and automate the task of bringing a platform to a known desired attitude. (Although, in the art, these systems are sometimes referred to as "mobile platform automatic positioning systems", this document will refer to them as mobile platform automatic attitude adjustment systems, or just "platform attitude adjustment systems" for short. This is because the word "positioning" has connotations more closely related to translation of a body through space rather than the adjustment of the attitude of a body "in-place." This document uses the word "system" to refer simultaneously to both an apparatus and a process (or method) carried out by that apparatus.)

Recent improvements in sensor technology, combined with the falling prices of semiconductors and microprocessors, are advancing the state-of-the-art in platform attitude adjustment systems. Where, in the past, jack movement was coordinated through the use of discrete circuitry and limited feedback, today it is known for computer processors to use new sensor technologies and advanced algorithms to adjust platform attitudes faster, safer, and more accurately than before. Today's systems are several orders of magnitude more sophisticated and powerful than their predecessors, allowing for unprecedented levels of control and reliability in their operation, but are configured to operate only hydraulically-actuated jacks.

When using jacks to adjust the attitude of a platform, the platform's total range of motion depends mainly on the distance between the jacks, and the total stroke lengths of the jacks. A platform attitude adjustment system cannot position or change the attitude of a platform beyond the point where all jack stroke has been used up.

The diagrams shown in FIGS. 1 and 2 schematically illustrate the basic relationship between platform position and jack stroke in a simplified two-jack system in which one jack extends or retracts while the other jack remains stationary. In such systems a stationary pivot point of the platform is located at the stationary jack. In most applications there are at least four jacks supporting a platform in spaced locations, e.g., near each of the four corners of a generally rectangular platform. However, for the sake of simplicity, as with FIGS. 1 and 2, this document will address the operation of the attitude adjustment system with respect to only two adjacent jacks.

The following parameters are used to trigonometrically describe the total attitude adjustment capability of a platform positioning system:

h=maximum stroke of jack w=distance between any two jacks

If one jack uses up its entire stroke and the other remains stationary, the largest angle (θ) through which the platform may be tilted in the axis of the two jacks is calculated using the following equation:

$$\theta = \tan^{-1}\left(\frac{h}{w}\right)$$

When designing a platform attitude adjustment system, the jack stroke and placement must be carefully chosen to ensure that the system can move a supported platform through a desired range of attitudes. In most mobile platform attitude adjustment applications, the amount of distance between supporting jacks depends primarily on platform geometry and is not likely to be adjustable. The only variable a designer is generally free to modify with regard to the selection and arrangement of jacks for a given mobile platform application is in the stroke lengths of the jacks. To reduce the cost of the jacks in a platform attitude adjustment system, jacks should be selected that have the shortest stroke lengths possible. However, the jack stroke lengths must be long enough to ensure that the jacks are able to move the platform through a predetermined desired range of attitudes.

It is known for mobile platform automatic attitude adjustment systems to include controllers programmed to coordinate jack movement. For example, U.S. Pat. No. 5,143,386 issued 1 Sep. 1992 to Uriarte, discloses a mobile platform attitude adjustment system that includes a plurality of jacks supporting a platform and powered by respective electric jack motors. A controller is connected to each of the jack drive mechanisms and is programmed to adjust the attitude of the platform by controlling the operation of the jacks. The controller of the Uriarte system is further programmed to coordinate the operation of the jacks as the jacks are adjusting the attitude of the platform. More specifically, the controller adjusts individual jack speeds in accordance with which part of the platform is lowest. However, a mobile platform attitude adjustment system constructed according to the Uriarte patent is unable to increase the range of attitudes through which a platform can be adjusted for a given jack stroke length.

What is needed is a mobile platform attitude adjustment system that coordinates jack actuation in such a way as to increase the range of attitudes through which a platform can be adjusted for a given jack stroke length. This would allow jacks of a shorter stroke length to be selected when designing or adapting a mobile platform attitude adjustment system to suit a given application.

BRIEF SUMMARY OF THE INVENTION

According to the invention, a platform attitude adjustment augmentation apparatus is provided for increasing attitude adjustment range for platforms supported by jacks of a given stroke length. The apparatus includes jacks configured to support a platform at spaced-apart locations and jack drive mechanisms drivingly connected to the respective jacks. A controller is connected to each of the jacks through their respective jack drive mechanisms and is programmed to adjust the attitude of a platform by controlling the operation of the jacks and coordinating their movement as the jacks are adjusting platform attitude. The controller is further programmed to coordinate the movement of the jacks by selecting and commanding at least one of the jacks to retract and selecting and commanding at least one other of the jacks to extend to increase the range of possible platform attitudes for a given jack stroke length.

According to another aspect of the invention the controller is programmed to coordinate the movement of the two selected jacks by commanding one of the selected jacks to retract while the other of the selected jacks is extending. This allows the apparatus to achieve a desired platform attitude more quickly.

According to another aspect of the invention the controller is configured to identify and select which jack is best positioned to achieve a desired attitude by being driven in extension, and to identify and select which jack is best positioned to augment the achievement of a desired platform attitude by being driven in retraction.

According to another aspect of the invention the controller is configured to identify and select which jack is best positioned to speed the achievement of a desired platform attitude by being driven in retraction.

According to another aspect of the invention the controller is programmed to time-limit the movement of the retracting jack to prevent the retracting jack from retracting too far and losing contact with the ground.

According to another aspect of the invention the jack drive mechanisms include direct-drive DC electric jack motors configured to drive the jacks in extension and retraction.

The invention also includes a method for increasing platform attitude adjustment range for a platform supported by jacks of a given stroke length. According to this method one can increase platform attitude adjustment range by determining and selecting, from a plurality of jacks supporting a platform, a first jack of the plurality of jacks that needs to be extended to achieve a desired platform attitude and determining and selecting a second jack of the plurality of jacks that, if retracted, will augment the achievement of the desired platform attitude. The first jack is commanded to extend and the second jack is commanded to retract, thereby increasing the range of attitude adjustment for a given jack stroke length in an axis of tilt defined between the first and second jacks.

According to another aspect of the inventive method, the step of determining a first jack includes selecting a jack that is closest to a portion of the platform that needs to be raised the greatest distance to achieve the desired platform attitude.

According to another aspect of the inventive method, the step of determining a first jack includes determining current platform attitude by analyzing signals from a tilt sensor supported on the platform and comparing current platform attitude to the desired platform attitude.

According to another aspect of the inventive method, the step of determining a second jack includes selecting a jack that is closest to a portion of the platform that can best augment the achievement of a desired platform attitude by being lowered.

According to another aspect of the inventive method, the step of commanding the second jack to retract includes commanding the second jack to retract while the first jack is extending to more rapidly achieve a desired platform attitude.

According to another aspect of the inventive method, the method includes the additional steps of determining a base period, determining a pulse portion of each base period during which the second jack is driven in retraction, and determining a maximum number of pulses for which the second jack can be driven in retraction without causing the second jack to lose ground contact. During the step of commanding the first jack to extend, a cycle counter configured to count the pulses is reset and a time counter is started. The second jack is commanded to start retracting and the time counter is restarted once the time counter reaches a time value equal to the difference between the base period and the pulse. If, when the time counter value equals the pulse value the cycle counter value is less than the maximum number of pulses, the cycle counter is incremented, the second jack is disabled, and another base period is initiated by returning to the step where only the first jack is driven in extension and the time counter is started. The second jack is commanded to start retracting again once the time counter again reaches a value equal to the difference between the base period and the pulse. If, when the time counter value equals the pulse value the cycle counter value is greater than or equal to the maximum number of pulses, the cycle counter is incremented and the second jack is disabled for the remainder of the time that the first jack is driven in extension to prevent the second jack from retracting too far and losing contact with the ground.

BRIEF DESCRIPTION OF THE SEVERAL VIEWS OF THE DRAWINGS

These and other features and advantages of the invention will become apparent to those skilled in the art in connection with the following detailed description and drawings, in which.

DETAILED DESCRIPTION OF INVENTION EMBODIMENT(S)

Figure 4:
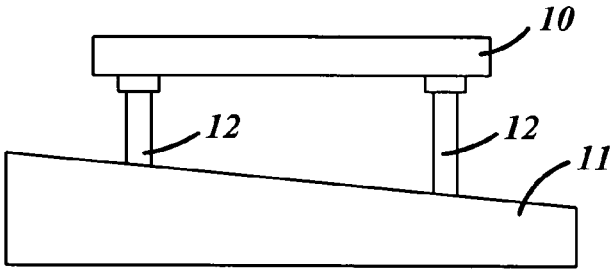
FIG. 4 is a schematic front view of a pair of jacks supporting a platform over ground.
Figure 5:
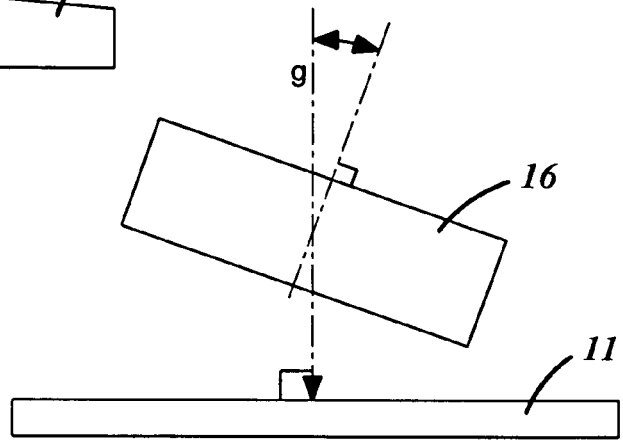
FIG. 5 is a schematic front view of a tilt sensor shown tilted relative to earth gravity.
Figure 7:
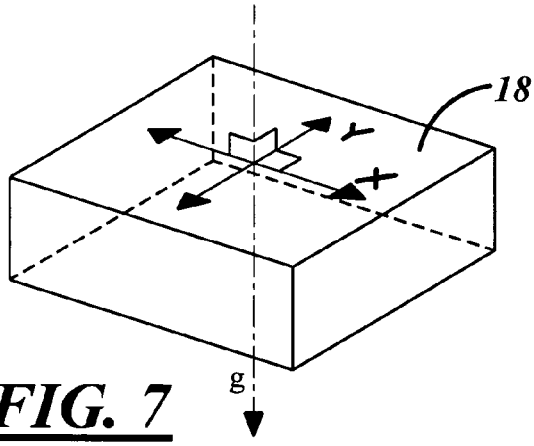
FIG. 7 includes a schematic orthogonal view of a dual-axis tilt sensor shown oriented relative to earth gravity.
Figure 8:
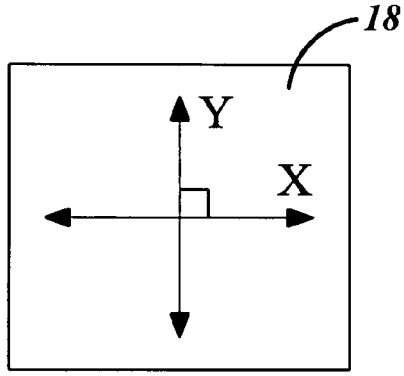
FIG. 8 includes schematic top view of the dual-axis tilt sensor of FIG. 7 shown oriented relative to earth gravity.
Figure 9:
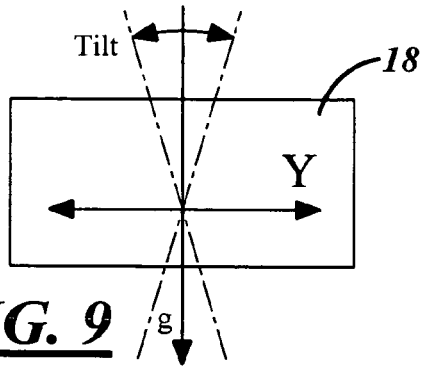
FIG. 9 includes schematic side view of the dual-axis tilt sensor of FIG. 7 shown oriented relative to earth gravity.
Figure 10:
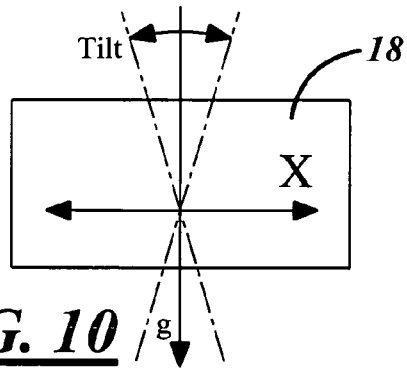
FIG. 10 includes schematic front view of the dual-axis tilt sensor of FIG. 7 shown oriented relative to earth gravity.
Figure 6:
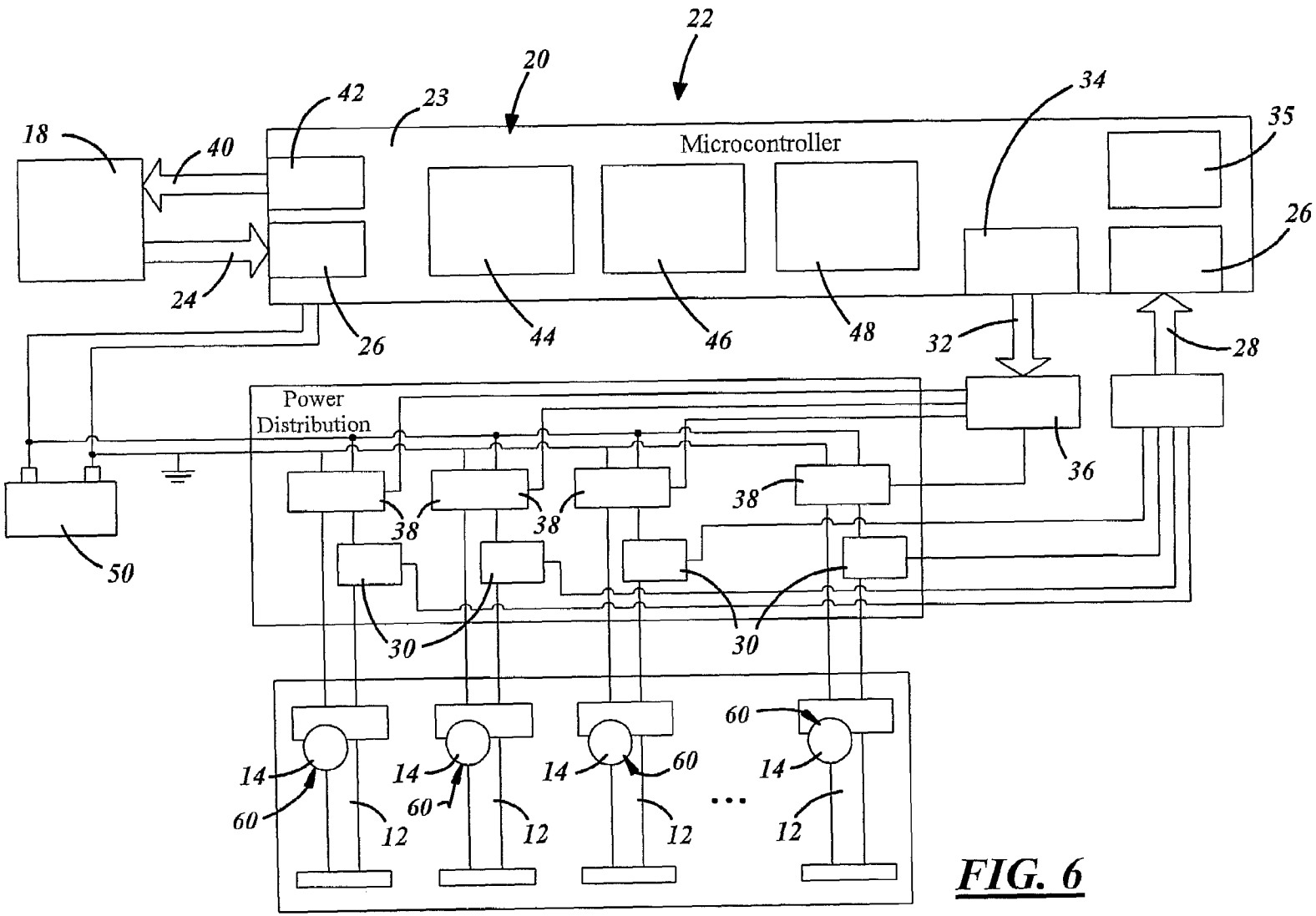
FIG. 6 is a schematic block diagram of a mobile platform attitude adjustment apparatus constructed according to the invention.
Figure 11:
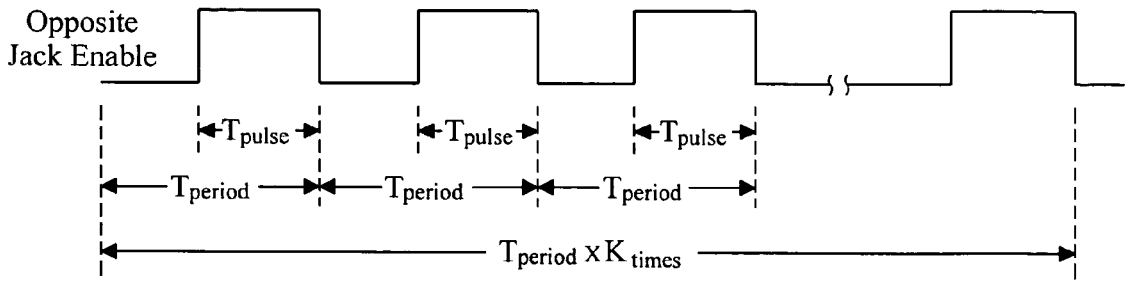
FIG. 11 is a graph depicting how the speed of a retracting jack is modulated during a jack coordination process implemented by the platform attitude adjustment apparatus of FIG. 1.

In this document the term "platform" refers to a body, such as the one shown at 10 in FIG. 4, which is to be raised relative to the ground 11 and its attitude adjusted in preparation for performing some operation or for accommodating certain activities to be carried out on the platform 10. The term "jack" refers to a mechanism for raising heavy objects by means of force applied with a lever, screw, or press. In this paper, the jacks, as shown at 12 in FIGS. 4 and 6, are of a type driven by motors 14 powered by direct electrical current (DC electrical power) as shown in FIG. 6. The term "tilt sensor" refers to a sensor, such as the sensor shown at 16 in FIG. 5, that's designed to detect the angle of tilt between a vertical axis through the sensor 16 and Earth gravity "g". The term "dual axis tilt sensor" refers to a tilt sensor capable of detecting the angle between the sensor and the Earth's gravity in two tilt axes, each perpendicular to the other. In FIGS. 7-10 a dual axis tilt sensor is shown at 18. The two tilt axes that the tilt sensor uses as references may be any two imaginary straight lines extending perpendicular to one another in a plane defined by the respective points where the jacks of a leveling system engage a platform 10 that the jacks are supporting. Although this embodiment of the invention may be adapted to level platforms of a variety of configurations using any number of jacks and assigning any two imaginary lines as tilt axes, to simplify this discussion this description will refer to a rectangular platform 10 supported by jacks located in each of its four corners, and will refer to a longitudinal tilt axis X extending the length of the platform 10 and a lateral tilt axis Y extending perpendicular to the longitudinal tilt axis X and along the width of the platform 10 as shown in FIGS. 7-10.

A platform attitude adjustment augmentation apparatus for increasing platform attitude adjustment range for platforms supported by jacks of a given stroke length is generally indicated at 20 in FIG. 6. The apparatus 20 is incorporated in a mobile platform attitude adjustment system generally shown at 22 in the same Figure. The mobile platform attitude adjustment system 22 is, in turn, mountable to a mobile platform 10 whose attitude is to be adjusted. As shown in FIG. 6 the apparatus 20 is electrically connected to each jack 12. The jacks 12 are mounted at spaced-apart locations around the mobile platform 10 whose attitude is to be adjusted and are extendable to contact the ground beneath the platform 10 and to support the platform 10 on the ground at the spaced-apart locations.

As is also shown in FIG. 6 the platform attitude adjustment augmentation apparatus 20 includes a controller 23 that is also the controller for the platform attitude adjustment system 22. Details relating to the construction and operation of a platform attitude adjustment apparatus employing such a controller can be found in U.S. Pat. No. 6,584,385, which issued 24 Jun. 2003 to Ford et al., and U.S. patent application Ser. No. 10/318,820 (published as 20030135312), both of which are assigned to the assignee of the present invention, and are incorporated herein by reference.

Figure 1:
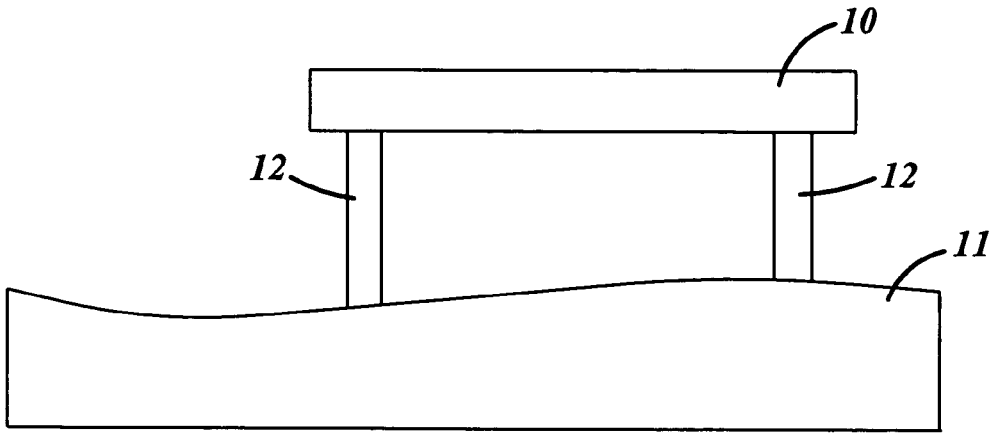
FIG. 1 is a schematic front view of a platform supported by two jacks on the ground in an original position before the jacks have been actuated to adjust the attitude of the platform.
Figure 2:
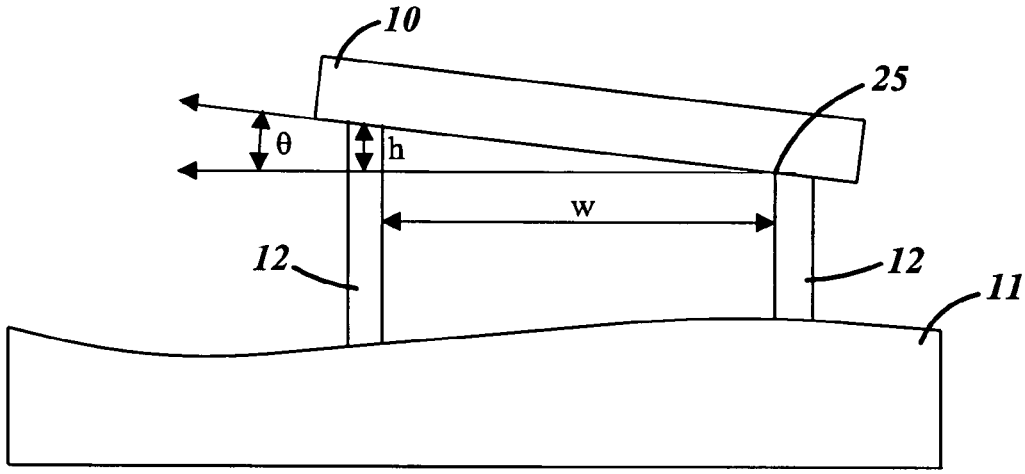
FIG. 2 is a schematic from view of the platform and jacks of FIG. 1 with one jack extended from the original position shown in FIG. 1 to illustrate the basic relationship between platform attitude and jack stroke when a desired attitude is achieved by extending one jack.

As is further shown in FIG. 6, the controller 23 receives signals 24 representing platform attitude from the dual-axis tilt sensor 18 through an analog-to-digital converter 26. The controller 23 also receives feedback signals 28 from each of a plurality of jacks 12 from current sensors 30 through the analog-to-digital converter 26. While FIG. 2 shows two ADC blocks, it's understood that the apparatus 20 may use either two analog-to-digital converters or single analog-to-digital converter including an ADC conversion circuit capable of individually converting signals from different signal sources, e.g., by internally multiplexing signals received via a plurality of channels.

The controller 23 is capable of sending control signals 32 to the jacks 12 through a first I/O port 34, a relay control 36, and respective H-bridge relays 38. The controller 23 is also capable of sending control signals 40 to the dual-axis tilt sensor 18 through a second I/O port 42. The controller 23 includes a central processing unit 44, a software-implemented digital signal processor 46, and control algorithms 48. A battery 50 provides electrical power to the jacks 12 through the H-bridge relays 38 as well as to the controller 23.

Figure 3:
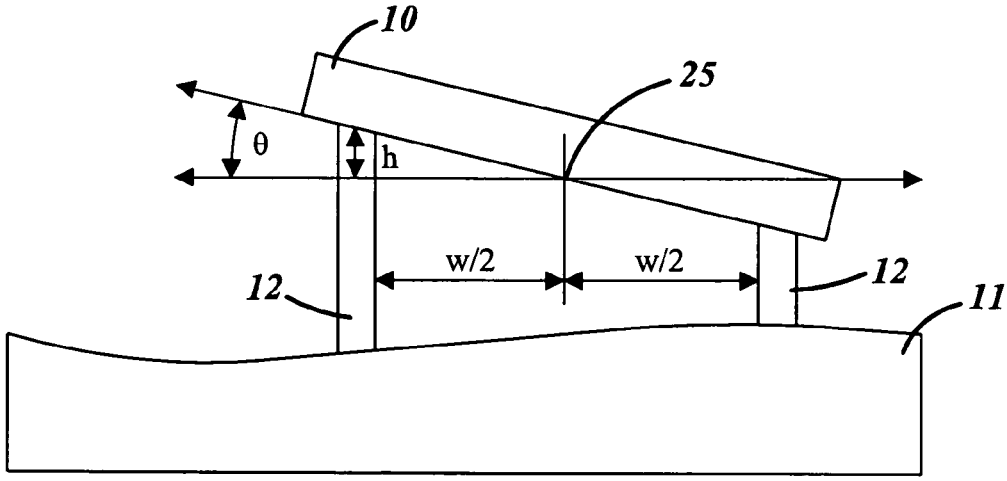
FIG. 3 is a schematic from view of the platform and jacks of FIG. 1 with one jack extended from its original position shown in FIG. 1 and the other jack retracted from its original position shown in FIG. 1 to illustrate the basic relationship between platform attitude and jack stroke when a desired attitude is achieved by extending one jack and retracting the other jack.

The controller 23 is programmed to adjust the attitude of a platform 10 by controlling the operation of the jacks 12 and coordinating their movement. The controller 23 is further programmed to coordinate the movement of the jacks 12 in a given axis of tilt X, Y by selecting and commanding one jack 12 of the plurality of jacks to retract and selecting and commanding another to extend so as to increase the range of possible platform attitudes for a given jack stroke length. As shown in the diagram of FIG. 3, when the controller 23 allows two jacks 12 to stroke by the same amount, but in opposite directions, the pivot point 25 of the platform 10 is disposed midway between the two jacks 12 instead of at one of the jacks 12 as is the case when only one jack 12 is extended as shown in FIG. 2. Causing the jacks 12 to move in opposite directions thus increases the maximum tilt of the platform 10 according to the equation:

$$\theta = \tan^{-1}\left(\frac{2h}{w}\right)$$

On average, a system tilt capability can be increased by a factor of 1.5× using this method. For small tilt angles, the system capability is increased by nearly a factor of two.

The platform attitude adjustment augmentation apparatus 20 includes a jack drive mechanism 60 for each jack. Each of the jack drive mechanisms 60 includes one of the jack motors 14 and drivingly connects that jack motor 14 to one of the jacks 12. The controller 23 is connected to each of the jack drive mechanisms 60 and is programmed to drive each jack 12 in extension by causing that jack's associated jack motor 14 to operate in one direction and to drive each jack 12 in retraction by causing its jack motor 14 to operate in the opposite direction. The jack motors 14 of the present embodiment are direct-drive DC electric motors. In other embodiments, any suitable type of electric motor may be used.

The controller 23 is programmed to coordinate the movement of the jacks 12 by commanding at least one of the jacks 12 or sets of jacks to retract while commanding at least one other of the jacks 12 or sets of jacks to extend. The controller 23 is programmed to identify and select whichever of the jacks 12 or sets of jacks is best positioned to achieve or speed the achievement of a desired attitude by being driven in extension. The controller 23 is also programmed to identify and select whichever of the jacks 12 or set of jacks is the "opposite" of the jack or set of jacks identified and selected for extension, i.e., the jack or set of jacks best positioned to augment the achievement of a desired platform attitude by being driven in retraction. To prevent the retracting or "opposite" jack or set of jacks from retracting too far and losing contact with the ground the controller 23 is also programmed to time-limit the movement of the retracting jack or set of jacks.

Figure 12:
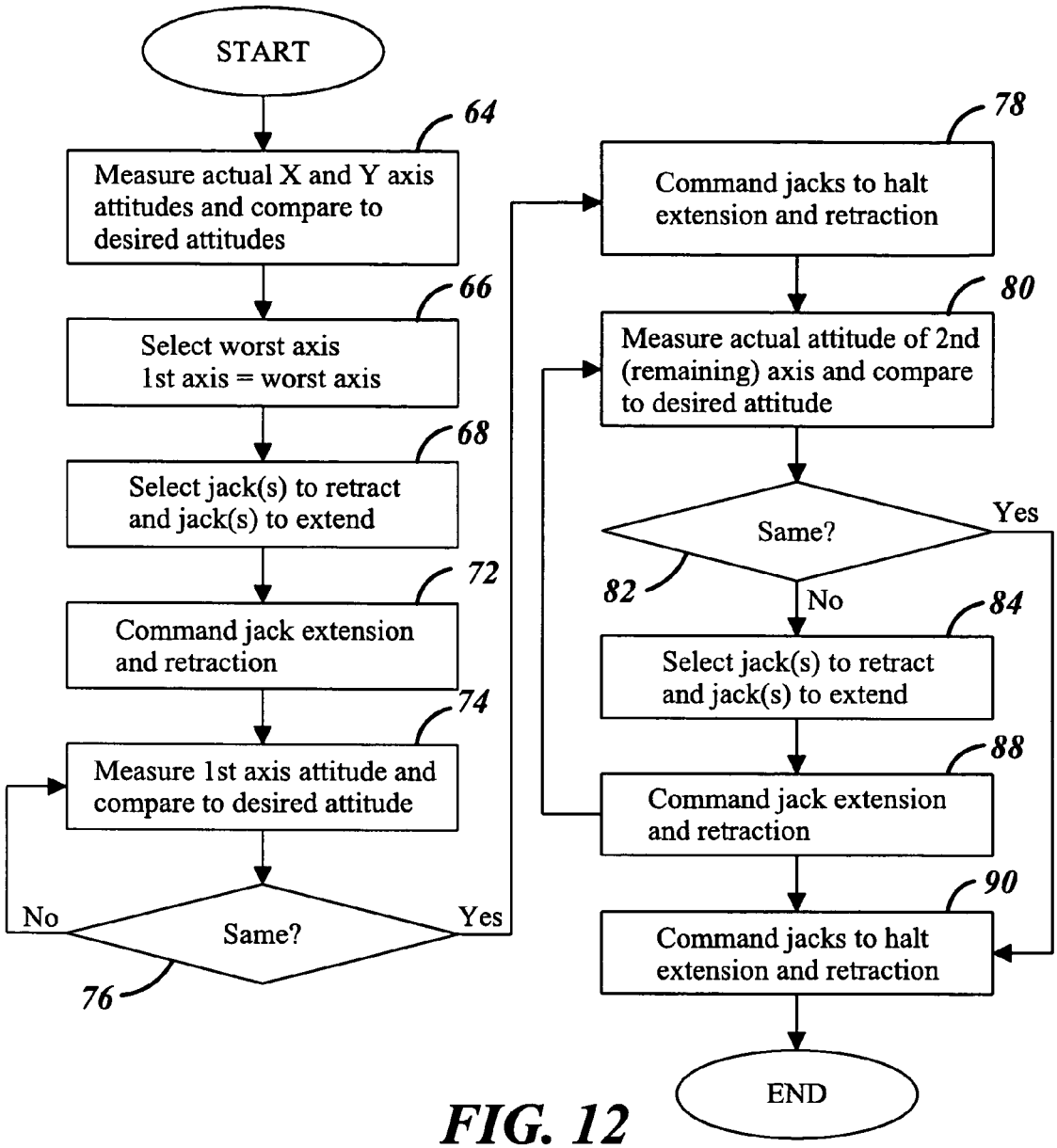
FIG. 12 is a flow chart showing a jack coordination process executed according to the invention by the platform attitude adjustment apparatus of FIG. 1.

In practice, augmenting or increasing platform attitude adjustment range for platforms 10 supported by jacks 12 of a given stroke length can be accomplished by first taking the preliminary steps of first determining current platform attitude by measuring the actual attitudes of the X and Y axes based on signals received from the tilt sensor 18 as shown in action step 64 of the process flow chart of FIG. 12. The controller then compares these values to the corresponding X and Y axis attitude values for a desired platform attitude as is also shown in action step 64 and determines and selects, as shown in action step 66, which axis X, Y is farthest from its desired attitude. Starting with the axis that is farthest from its desired attitude, the controller determines from a plurality of jacks 12 supporting a platform 10 which jack or set of jacks must be extended to help achieve or speed the achievement of the desired platform attitude in that axis as shown in action step 68. Typically, this jack or set of jacks is whichever jack or set of jacks is closest to a portion of the platform 10 that needs to be raised the greatest distance to achieve the desired platform attitude. As shown in action step 68, the controller also determines which jack or set of jacks of the plurality of jacks 12, if retracted, will augment or speed the change from the current platform attitude to the desired platform attitude in that axis. Typically, this second jack, or second set of jacks selected for retraction, is the one closest to a portion of the platform 10 that, by being lowered, will best augment or speed the achievement of the desired platform attitude in the axis farthest from its desired attitude. The first jack or set of jacks is then commanded to extend and the second jack or set of jacks is commanded to retract as shown at action step 72. To more rapidly achieve the desired platform attitude the second jack or set of jacks may be commanded to retract while the first jack or set of jacks is extending. As shown at action step 74 and decision step 76 the controller monitors the changing attitude of the first axis and, once it reaches its desired attitude, stops driving the jacks as shown at action step 78 and measures and compares the attitude of the remaining axis as shown at action step 80. If the controller determines at decision step 82 that the second axis is not at its desired attitude, it determines and selects which jacks or sets of jacks will most rapidly achieve that attitude through extension and which jack or set of jacks will best augment that process at action step 84 and then, at action step 88 drives those jacks or sets of jacks in extension and retraction, respectively. The controller continues to monitor the changing attitude of the second axis as shown at action point 80 and then, at decision point 82, when the second axis reaches its desired attitude, the controller stops driving the jacks as shown at action point 90.

Loss of ground contact by the retracting jack or set of jacks may be prevented by preliminarily determining a base period ($T_{period}$), determining a retraction pulse portion ($T_{pulse}$) of each base period during which the second jack or set of jacks is to be driven in retraction, and determining a maximum number of cycles ($K_{max}$) during which the second jack or set of jacks can be driven in retraction for the pulse period without causing the second jack to lose ground contact. These values are stored in the apparatus 20, preferably in non-volatile reprogrammable memory 35 such as EEPROM to allow the parameters to be updated to reflect more accurate or recent calculations, or changed to adapt to different applications or conditions. This allows the latest parameter values to be programmed into the product at the end of the production line and/or modified after the product is built. This method is typically implemented on new products where it's advisable to allow for parameter changes that may be implemented during early production. It's also useful to implement this method during the development phase of a product, when parameters are being determined and change daily. However, some or all of the parameters may alternatively be hard-coded into program ROM. This is a lower cost solution that may be implemented on mature products for which parameter values have not changed for a long period of time and are not expected to change in the foreseeable future.

Figure 13:
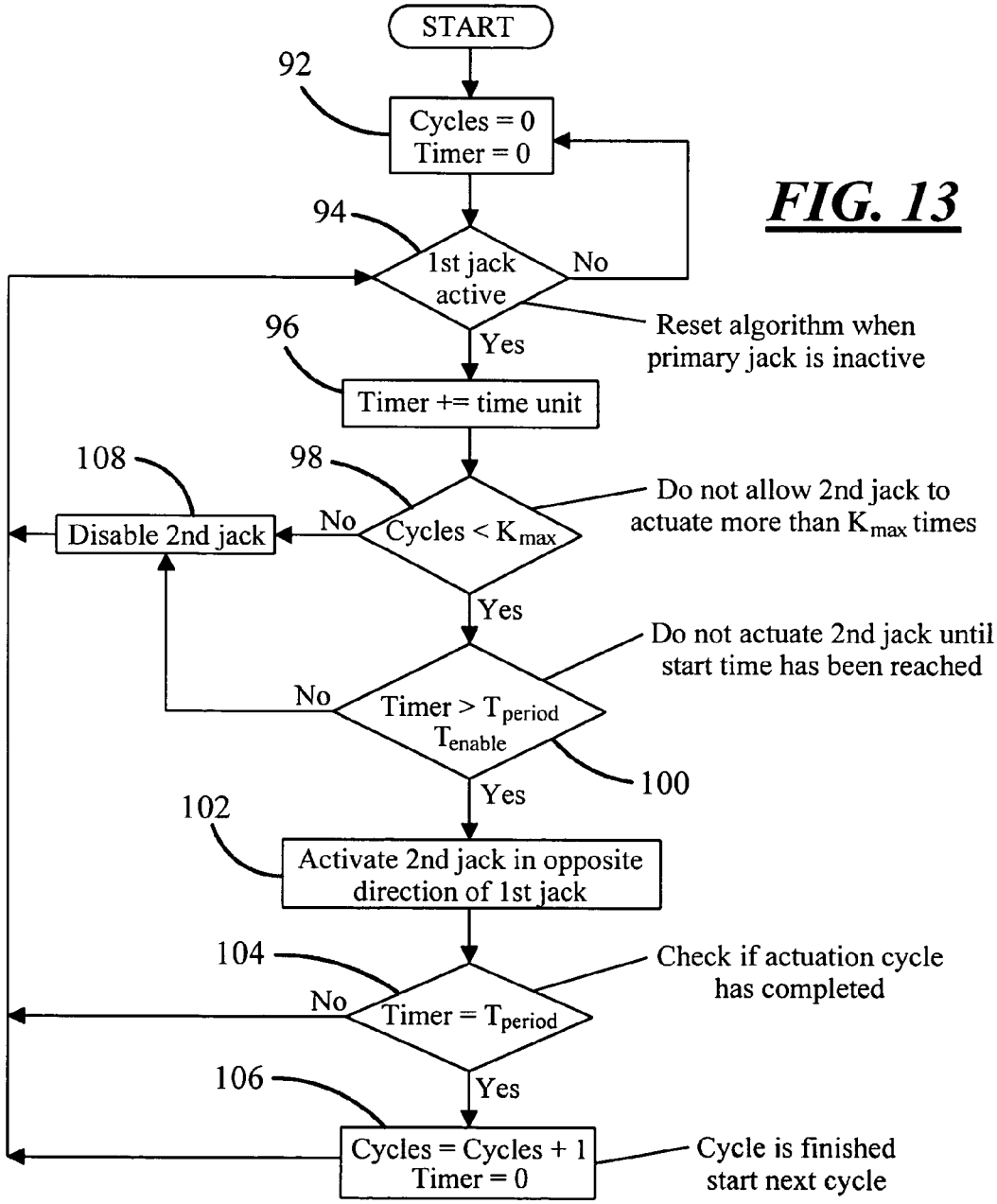
FIG. 13 is a flow chart showing a process for preventing loss of ground contact by jacks commanded to retract in the jack coordination process of FIG. 12.

When an attitude adjustment process is started the controller 23 initiates an augmentation process using the data obtained in the preliminary steps described above. The augmentation process, which is shown in FIG. 13, begins by initially setting a time counter and a cycle counter to zero as shown at action point 92. The time counter measures elapsed time and the cycle counter counts the number of cycles and, therefore, the number of retraction drive pulses included in each of those cycles. In the present embodiment the time counter and cycle counter are software functions of the controller 23. However, in other embodiments any suitable form of time counter and cycle counter may be used.

After the time counter and cycle counter are initially set to zero, if the first jack or set of jacks is determined to be active at decision point 94 then the time counter is incremented by one time unit as shown at action point 96. If the cycle counter value is determined to be less than the maximum number of cycles ($Cycles<K_{max}$) at decision point 98, and the time counter measures an elapsed time value less than or equal to the difference between the base period and the pulse period ($Timer \leqq T_{period}-T_{pulse}$) at decision point 100, then the pulse portion of the period has not yet been reached, the second jack or set of jacks remains disabled as shown at action point 102, and the process returns to the point, decision point 94, where the controller determines whether the first jack or set of jacks is active. If the cycle counter value is less than the maximum number of cycles ($Cycles<K_{max}$) at decision point 98, but the time counter measures an elapsed time value greater than the difference between the base period and the pulse period ($Timer>T_{period}-T_{pulse}$) at decision point 100, then the pulse period has begun and the second jack is activated in retraction as shown at action point 102. The second jack or set of jacks remains activated for the duration of the pulse period, i.e., as long as the time counter measures an elapsed time value less than or equal to the base period value as determined at decision point 104, and as long as the first jack or set of jacks remains active as determined at decision point 102.

Once the time counter measures an elapsed time equal to the base period value (Timer=$T_{period}$) at decision point 104 the time counter is reset to zero and the cycle counter is incremented as shown at action point 106. The process then returns to the point, decision point 94, where the controller determines whether the first jack or set of jacks remains active. If, when returning to decision point 94 the controller finds that the first jack or set of jacks is no longer active, the time counter and cycle counter are both reset to zero at action point 92. If, instead, when returning to decision point 94 the first jack or set of jacks is determined to still be active, another base period is imitated by incrementing the timer at action step 96 and commanding the second jack or set of jacks to start retracting again once the time counter again reaches a value equal to the difference between the base period and the pulse (Timer=$T_{period}$−$T_{pulse}$) as determined at decision step 100.

If, upon returning to decision point 94 the first jack or set of jacks is determined to still be active but at decision point 98 the cycle counter value is determined to be greater than or equal to the maximum number of cycles (Cycles≧$K_{max}$), the cycle counter is incremented and the second jack or set of jacks is disabled at action point 108 for the remainder of the time that the first jack or set of jacks is driven in extension to prevent the second jack or set of jacks from retracting further.

By employing a platform attitude adjustment system constructed according to the invention, for a given attitude range requirement, the jack stroke length requirement can be significantly reduced, resulting in cost savings. In addition, a system constructed according to the invention will, by driving jacks or sets of jacks in opposite directions simultaneously, allow the attitude of a platform to be adjusted faster since a larger tilt angle is covered over a given amount of time.

This description is intended to illustrate certain embodiments of the invention rather than to limit the invention. Therefore, it uses descriptive rather than limiting words. Obviously, it's possible to modify this invention from what the description teaches. Within the scope of the claims, one may practice the invention other than as described.

What is claimed is:

1. A platform attitude adjustment augmentation apparatus for increasing platform attitude adjustment range for a platform supported on and raised relative to ground by jacks of given stroke lengths, the apparatus comprising:

jacks configured to support a platform at spaced-apart locations on the ground by extending to contact the ground and to raise the platform relative to the ground;

jack drive mechanisms drivingly connected to the respective jacks;

a dual axis tilt sensor carried by the platform and configured to detect a platform attitude relative to Earth gravity and to transmit corresponding signals representing the platform attitude; and a controller connected to each of the jacks through their respective jack drive mechanisms, configured to receive the signals from the tilt sensor, and programmed to adjust the platform attitude to a desired platform attitude relative to Earth gravity in response to the signals received from the tilt sensor, by controlling the operation of the jacks and coordinating jack movement as the jacks are adjusting platform attitude, the controller being further programmed to:

coordinate the movement of the jacks to achieve the desired platform attitude by selecting and commanding at least one of the jacks to retract and selecting and commanding at least one other of the jacks to extend;

wherein selection and commanding of at least one jack to extend comprises identifying and selecting which jack is best positioned to achieve a desired platform attitude by being driven into extension, wherein the best positioned jack is the jack that is closest to a portion of the platform that needs to be raised the greatest distance to achieve the desired platform attitude;

wherein selection and commanding of at least one jack to refract comprises identifying and selecting which jack is best positioned to augment the achievement of a desired platform attitude by being driven in refraction, wherein the jack that is best positioned to augment the achievement of a desired platform attitude by being driven in retraction is the jack that increases the range of possible starting platform attitudes from which the desired platform attitude can be reached for a given jack stroke length of the at least one jack identified and selected for extension.

2. A platform attitude adjustment augmentation apparatus as defined in claim 1 in which the controller is programmed to coordinate jack movement by commanding one of the selected jacks to refract while another of the selected jacks is extending.

3. A platform attitude adjustment augmentation apparatus as defined in claim 1 in which the controller is programmed to coordinate jack movement by commanding a selected set of jacks to retract while another set of the selected jacks is extending.

4. A platform attitude adjustment augmentation apparatus as defined in claim 1 in which the controller is configured to identify and select which set of jacks is best positioned to achieve a desired platform attitude by being driven in extension, wherein the best positioned set of jacks, is the set of jacks. that are closest to a portion of the platform that needs to be raised the greatest distance to achieve the desired platform attitude.

5. A platform attitude adjustment augmentation apparatus as defined in claim 1 in which the controller is configured to identify and select which set of jacks is best positioned to augment the achievement of a desired platform attitude by being driven in retraction, wherein the set of jacks that is best positioned to augment the achievement of a desired platform attitude by being driven in retraction is the set of jacks that increases the range of possible starting platform attitudes from which the desired platform attitude can be reached for a given jack stroke length of the at least one jack identified and selected for extension.

6. A platform attitude adjustment augmentation apparatus as defined in claim 1 in which the controller is programmed to limit to a predetermined maximum time the time that the retracting jack is allowed to continue retracting.

7. A platform attitude adjustment augmentation apparatus as defined in claim 5 in which the controller is programmed to time-limit the movement of the retracting set of jacks.

8. A platform attitude adjustment augmentation apparatus as defined in claim 1 in which the jack drive mechanism include electric motors configured to drive the jacks in extension and retraction.

9. A platform attitude adjustment augmentation apparatus as defined in claim 8 in which the jack drive mechanisms include direct-drive DC electric jack motors configured to drive the jacks in extension and retraction.

10. A method for increasing platform attitude adjustment range for platforms supported on and raised relative to ground by jacks of given stroke lengths; the method including the steps of:

determining a current platform attitude of a platform relative to Earth gravity;

determining, from a plurality of jacks supporting the platform by having been extended into contact with the ground and having raised the platform relative to the ground, a first jack of the plurality of jacks that needs to be further extended to achieve a desired platform attitude from the current platform attitude;

wherein determining the first jack includes selecting a jack that is closest to a portion of the platform that needs to be raised the greatest distance to achieve the desired platform attitude;

determining a second jack of the plurality of jacks that, if refracted, will augment the achievement of the desired platform attitude by increasing the range of possible starting platform attitudes from which the desired platform attitude can be reached for a given jack stroke length of the first jack;

commanding the first jack to extend; and commanding the second jack to retract.

11. The method of claim 10 in which the step of determining the first jack includes determining current platform attitude by;

analyzing signals from a tilt sensor supported on the platform; and comparing current platform attitude to the desired platform attitude.

12. The method of claim 10 in which the step of determining the second jack includes selecting a jack that is closest to a portion of the platform that can best augment the achievement of a desired platform attitude by being lowered.

13. The method of claim 10 in which the step of commanding the second jack to retract includes commanding the second jack to refract while the first jack is extending.

14. The method of claim 10 including the additional steps of:

determining a base period;

determining a pulse portion of each base period during which the second jack is driven in retraction;

determining a maximum number of pulses for which the second jack can be driven in retraction without causing the second jack to lose ground contact;

during the step of commanding the first jack to extend, reselling a cycle counter configured to count the pulses and starting a time counter;

commanding the second jack to start retracting and restarting the time counter once the time counter reaches a time value equal to the difference between the base period and the pulse; and if, when the time counter value equals the pulse value the cycle counter value is less than the maximum number of pulses:

incrementing the cycle counter;

disabling the second jack; and initiating another base period by returning to the step where only the first jack is driven in extension and the time counter is started, and commanding the second jack to start retracting again once the time counter again reaches a value equal to the difference between the base period and the pulse; and if, when the time counter value equals the pulse value the cycle counter value is greater than or equal to the maximum number of pulses, incrementing the cycle counter and disabling the second jack for the remainder of the time that the first jack is driven in extension.

15. A method for increasing platform attitude adjustment range for platforms supported on and raised relative to ground by jacks of given stroke lengths; the method including the steps of:

determining a current platform attitude of a platform relative to Earth gravity;

determining, from a plurality of jacks supporting the platform by having been extended into contact with the ground and having raised the platform relative to the ground, a first set of jacks that needs to be further extended to achieve a desired platform attitude from the current platform attitude;

wherein determining the first set of jacks includes selecting a set of jacks that is closest to a portion of the platform that needs to be raised the greatest distance to achieve the desired platform attitude;

determining from the plurality of jacks a second set of jacks that, if retracted, will augment the achievement of the desired platform attitude by increasing the range of possible starting platform attitudes from which the desired platform attitude can be reached for given jack stroke lengths of the first set of jacks;

commanding the first set of jacks to extend; and commanding the second set of jacks to refract.

16. The method of claim 15 in which the step of determining the first set of jacks includes determining current platform attitude by;

analyzing signals from a tilt sensor supported on the platform; and comparing current platform attitude to the desired platform attitude.

17. The method of claim 15 in which the step of determining the second set of jacks includes selecting a set of jacks that is closest to a portion of the platform that can best augment the achievement of a desired platform attitude by being lowered.

18. The method of claim 15 in which the step of commanding the second set of jacks to retract includes commanding the second set of jacks to refract while the first set of jacks is extending.

19. The method of claim 15 including the additional steps of:

determining a base period;

determining a pulse portion of each base period during which the second set of jacks is driven in retraction;

determining a maximum number of pulses for which the second set of jacks can be driven in refraction without causing the second set of jacks to lose ground contact;

during the step of commanding the first set of jacks to extend, reselling a cycle counter configured to count the pulses and starting a time counter;

commanding the second set of jacks to start retracting and restarting the time counter once the time counter reaches a time value equal to the difference between the base period and the pulse; and if, when the time counter value equals the pulse value the cycle counter value is less than the maximum number of pulses:

incrementing the cycle counter;

disabling the second set of jacks; and initiating another base period by returning to the step where only the first set of jacks is driven in extension and the time counter is started, and commanding the second set of jacks to start retracting again once the time counter again reaches a value equal to the difference between the base period and the pulse; and if, when the time counter value equals the pulse value the cycle counter value is greater than or equal to the maximum number of pulses, incrementing the cycle counter and disabling the second set of jacks for the remainder of the time that the first set of jacks is driven in extension.

20. A platform attitude adjustment augmentation apparatus as defined in claim 1 in which the controller is programmed to adjust the attitude of at least a portion of the platform to true level in response to the signals received from the tilt sensor.

21. The method of claim 10 in which the desired platform attitude is true level.

22. The method of claim 15 in which the desired platform attitude is true level.

* * * * *

UNITED STATES PATENT AND TRADEMARK OFFICE

CERTIFICATE OF CORRECTION

PATENT NO. : 7,617,018 B2
APPLICATION NO. : 11/253144
DATED : November 10, 2009
INVENTOR(S) : Robert M. Ford et al.

It is certified that error appears in the above-identified patent and that said Letters Patent is hereby corrected as shown below:

Column 4, line 54, "from" should be --front--;

Column 4, line 59, "from" should be --front--;

Claim 1, column 10, line 10, "refract" should be --retract--;

Claim 1, column 10, lines 12, 13, "refraction" should be --retraction--;

Claim 2, column 10, line 23, "refract" should be --retract--;

Claim 4, line 22, "jacks, is the set of jacks." should be --jacks is the set of jacks--;

Claim 8, column 10, line 57, "mechanism" should be --mechanisms--;

Claim 10, column 11, line 14, "refracted" should be --retracted--;

Claim 13, column 11, line 35, "refract" should be --retract--;

Claim 14, column 11, line 44, "reselling" should be --resetting--;

Claim 15, column 12, line 24, "refract" should be --retract--;

Claim 18, column 12, line 38, "refract" should be --retract--;

Claim 19, column 12, line 46, "refraction" should be --retraction--;

Claim 19, column 12, line 49, "reselling" should be --resetting--.

Signed and Sealed this

Eleventh Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,617,018 B2
APPLICATION NO. : 11/253144
DATED : November 10, 2009
INVENTOR(S) : Robert M. Ford It is certified that error appears in the above-identified patent and that said Letters Patent is hereby corrected as shown below:

Title Page (*) Notice: should read, Subject to any disclaimer, the term of this patent is extended or adjusted under 35 U.S.C. 154(b) by 853 days.

Signed and Sealed this

Tenth Day of August, 2010

David J. Kappos

David J. Kappos
*Director of the United States Patent and Trademark Office*